US011145451B2

(12) United States Patent
Inaba

(10) Patent No.: US 11,145,451 B2
(45) Date of Patent: Oct. 12, 2021

(54) REACTOR

(71) Applicants: AutoNetworks Technologies, Ltd., Mie (JP); Sumitomo Wiring Systems, Ltd., Mie (JP); Sumitomo Electric Industries, Ltd., Osaka (JP)

(72) Inventor: Kazuhiro Inaba, Mie (JP)

(73) Assignees: AutoNetworks Technologies, Ltd., Yokkaichi (JP); Sumitomo Wiring Systems, Ltd., Yokkaichi (JP); Sumitomo Electric Industries, Ltd., Osaka (JP)

( * ) Notice: Subject to any disclaimer, the term of this patent is extended or adjusted under 35 U.S.C. 154(b) by 417 days.

(21) Appl. No.: 16/283,939

(22) Filed: Feb. 25, 2019

(65) Prior Publication Data

US 2019/0267177 A1 Aug. 29, 2019

(30) Foreign Application Priority Data

Feb. 26, 2018 (JP) ..... JP2018-032570

(51) Int. Cl.

| | |
|---|---|
| ***H01F 27/24*** | (2006.01) |
| ***H01F 27/02*** | (2006.01) |
| ***H01F 27/32*** | (2006.01) |
| ***H01F 27/28*** | (2006.01) |
| ***H01F 3/08*** | (2006.01) |
| ***H01F 37/00*** | (2006.01) |

(52) U.S. Cl.

CPC ..... *H01F 27/24* (2013.01); *H01F 3/08* (2013.01); *H01F 27/022* (2013.01); *H01F 27/2823* (2013.01); *H01F 27/32* (2013.01); *H01F 37/00* (2013.01)

(58) Field of Classification Search

CPC ..... H01F 27/24; H01F 37/00; H01F 27/022; H01F 27/32; H01F 27/2823; H01F 3/08; H01F 27/263; H01F 27/346

See application file for complete search history.

(56) References Cited

U.S. PATENT DOCUMENTS 4,583,068 A * 4/1986 Dickens ..... H01F 19/04 336/195
6,255,931 B1 * 7/2001 Chen ..... H01F 27/324 336/192

(Continued)

FOREIGN PATENT DOCUMENTS

JP 2014-003125 A 1/2014

*Primary Examiner* — Mang Tin Bik Lian
(74) *Attorney, Agent, or Firm* — Honigman LLP

(57) ABSTRACT

Provided is a reactor in which a resin is sufficiently filled into winding portions. The reactor includes a coil having a first winding portion and a second winding portion and a magnetic core having an inner core portion and an outer core portion. The outer core portion includes a first groove portion and a second groove portion that are open to a coil facing surface opposite to the coil. When viewed from the axial direction of the first winding portion, the opening of the first groove portion is located at a first region between the outer circumferential contour of the first winding portion and the outer circumferential contour of the inner core portion that is disposed inside of the first winding portion. The inner resin portion and the outer resin portion are connected via the first groove portion and the second groove portion.

9 Claims, 4 Drawing Sheets

(56) References Cited

U.S. PATENT DOCUMENTS

| | | | | |
|---|---|---|---|---|
| 2011/0156853 | A1* | 6/2011 | Kato | H01F 27/306<br>336/192 |
| 2013/0038415 | A1* | 2/2013 | Ooishi | H01F 37/00<br>336/61 |
| 2013/0127579 | A1* | 5/2013 | Ueno | H01F 27/263<br>336/212 |
| 2014/0218152 | A1* | 8/2014 | Ueno | H01F 3/14<br>336/165 |
| 2016/0189862 | A1* | 6/2016 | Miyauchi | H01F 41/005<br>29/606 |

* cited by examiner

【FIG. 1】
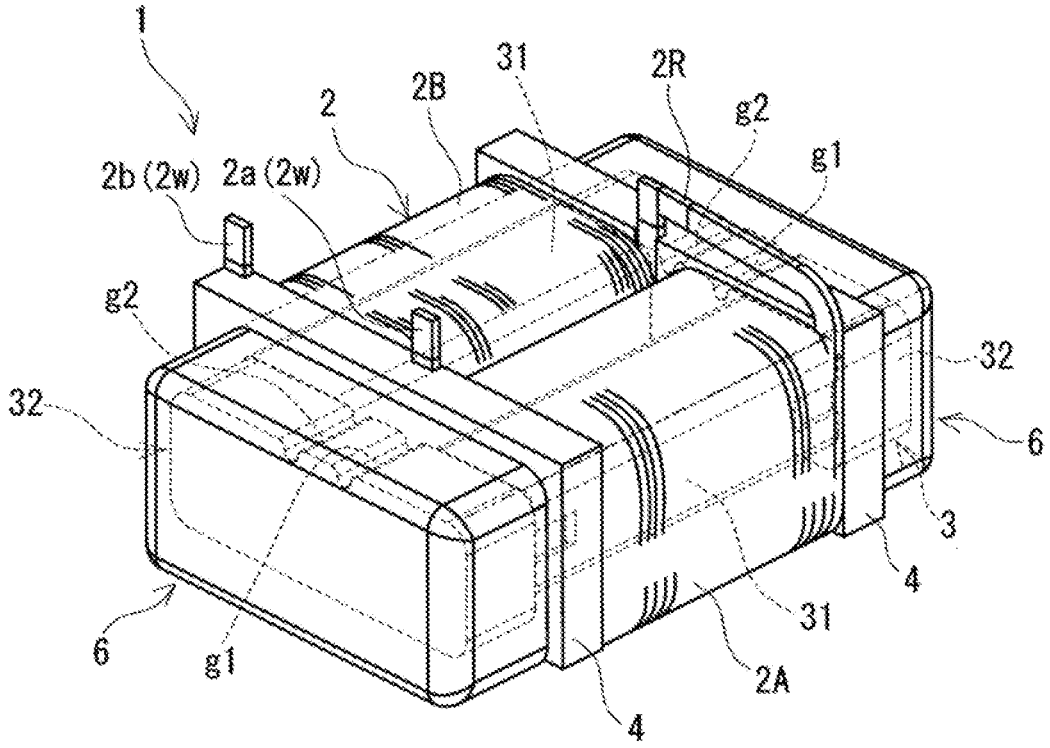
【FIG. 2】
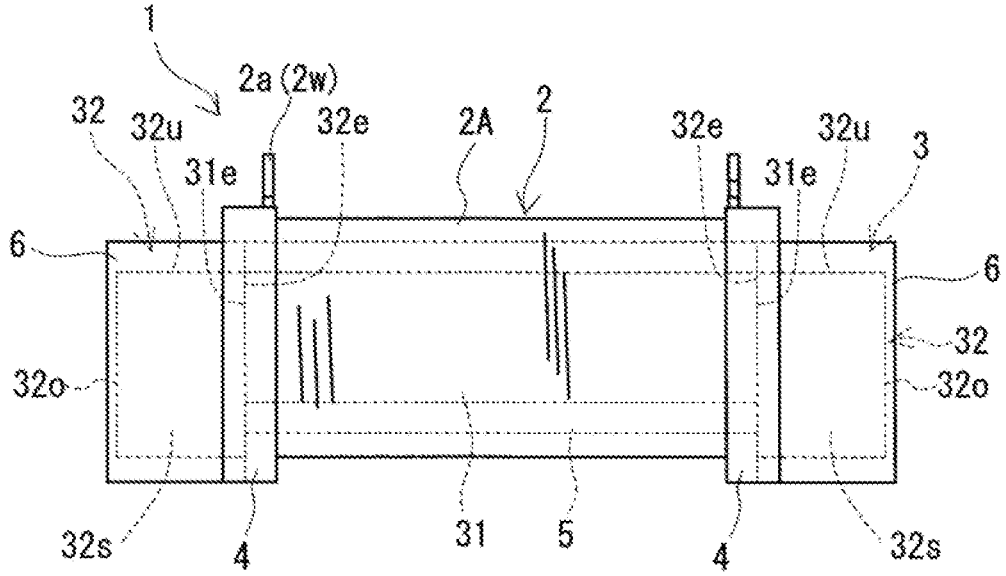

【FIG. 3】
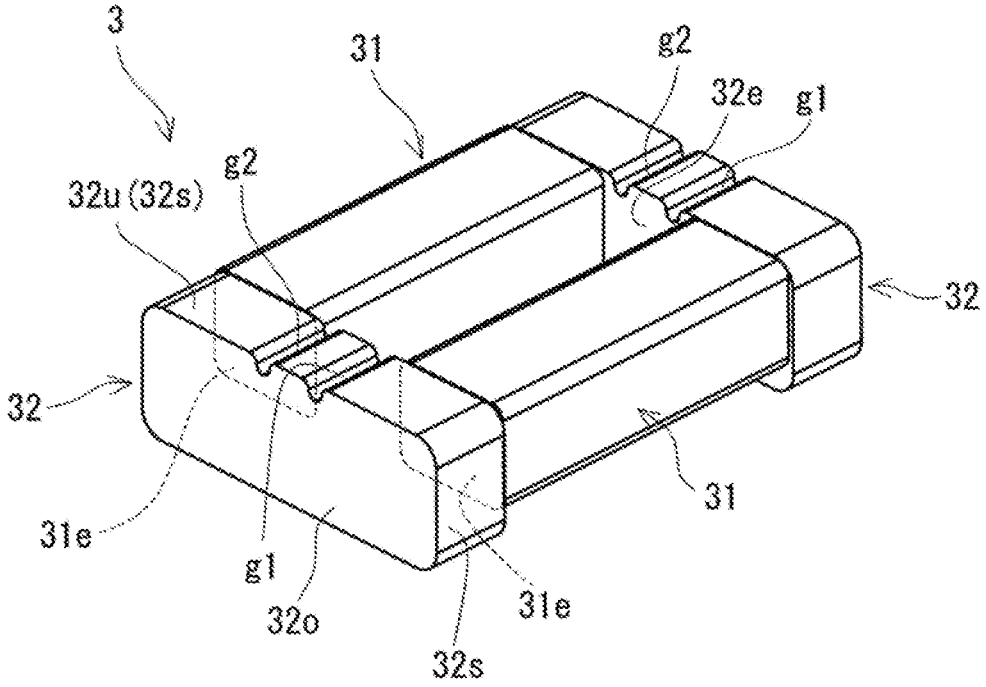
【FIG. 4】
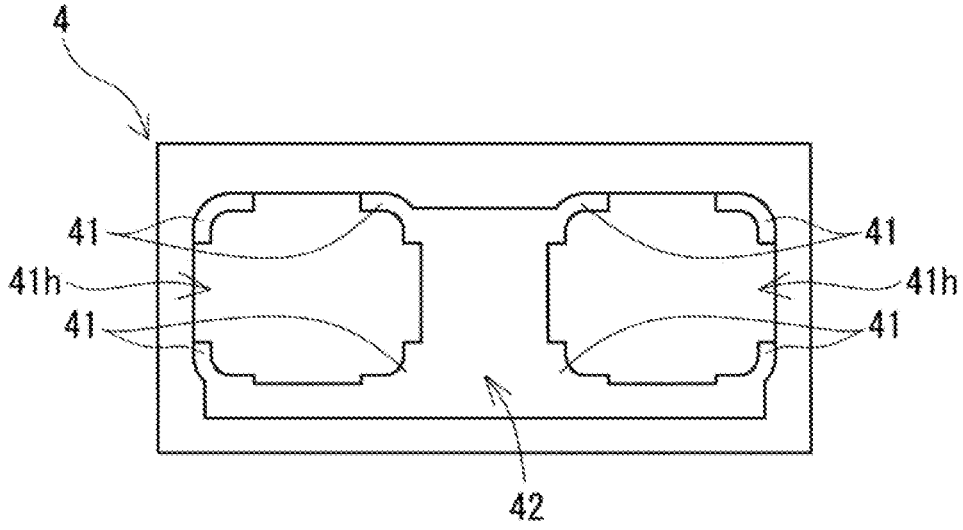

【FIG. 5】
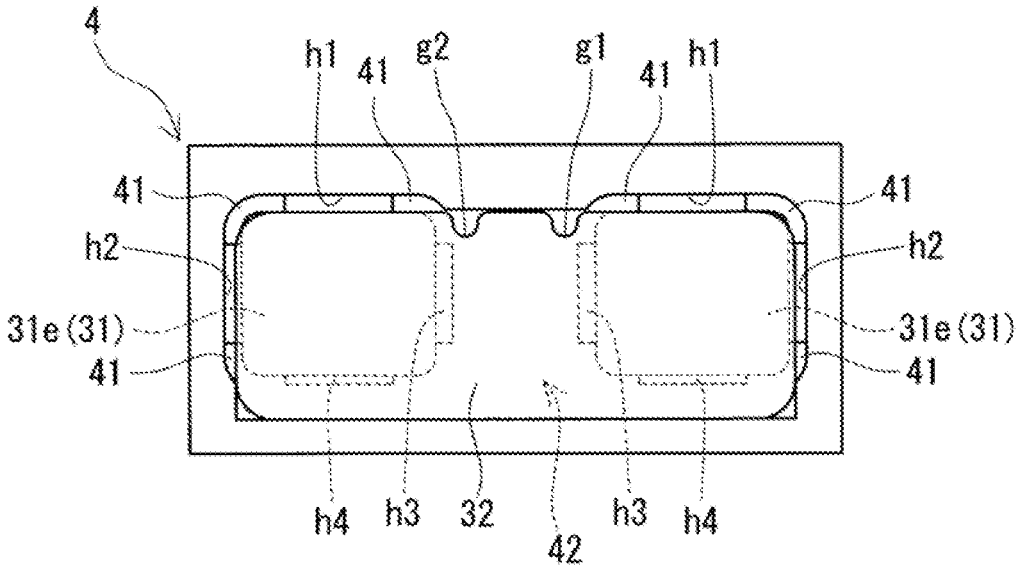
【FIG. 6】
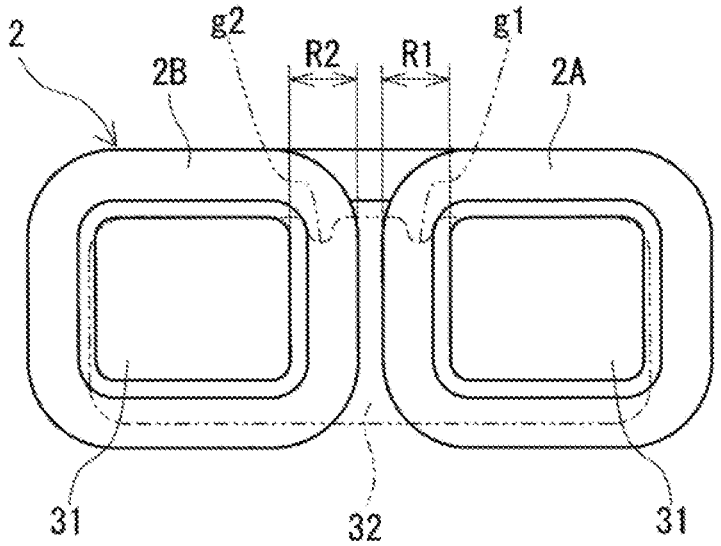

【FIG. 7】
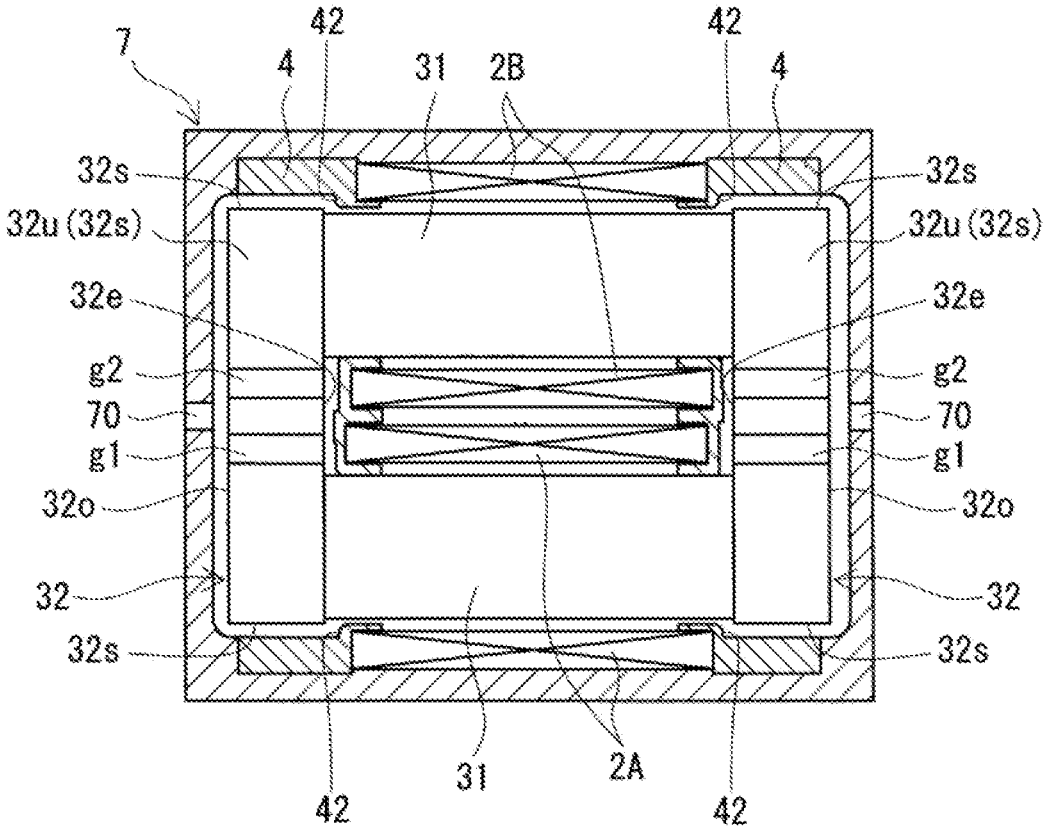

REACTOR

CROSS-REFERENCE TO RELATED APPLICATIONS

This application claims priority of Japanese Patent Application No. JP 2018-032570 filed Feb. 26, 2018.

TECHNICAL FIELD

The present disclosure relates to a reactor.

BACKGROUND

JP 2014-003125A discloses, for example, a reactor that includes a coil having a winding portion that is formed by winding a winding wire and a magnetic core forming a closed magnetic circuit, and is used for a component or the like of a converter of hybrid vehicles. The magnetic core of this reactor can be divided into an inner core portion disposed inside of the winding portion and an outer core portion disposed outside of the winding portion. In addition, JP 2014-003125A discloses a configuration in which a resin is filled inside of the winding portion of the coil.

SUMMARY

In the configuration disclosed in JP 2014-003125A, there are cases where a resin cannot be sufficiently filled inside of the winding portion. If the filling of the resin inside of the winding portion is insufficient, the strength of a component that is constituted by the resin (inner resin portion) decreases, compared to the case where the resin is sufficiently filled. As a result, the resin may be damaged by vibrations or the like during use of the reactor.

The present disclosure has been made in view of the above circumstances, and one objective of the present disclosure is to provide a reactor in which a resin is sufficiently filled inside of a winding portion.

A reactor according to this disclosure including a coil that has a first winding portion and a second winding portion and a magnetic core that has inner core portions, which are respectively disposed inside of the first winding portion and the second winding portion, and outer core portions that form an annular magnetic path with the inner core portions.

The reactor includes an inner resin portion that covers at least a part of the inner core portion and an outer resin portion that covers at least a part of the outer core portion. The outer core portion includes a first groove portion and a second groove portion that are open to a coil facing surface opposite to the coil, when viewed from the axial direction of the first winding portion. An opening of the first groove portion is located between the outer circumferential contour of the first winding portion and the outer circumferential contour of the inner core portion that is disposed inside the first winding portion, when viewed from the axial direction of the second winding portion. An opening of the second groove portion is located between the outer circumferential contour of the second winding portion and the outer circumferential contour of the inner core portion that is disposed inside the second winding portion. The inner resin portion and the outer resin portion are connected via the first groove portion and the second groove portion.

The reactor of this disclosure is a reactor in which a resin is sufficiently filled inside of the winding portion.

BRIEF DESCRIPTION OF THE DRAWINGS

FIG. 1 is a perspective view of a reactor of a first embodiment.

FIG. 2 is a schematic side view of the reactor in FIG. 1.

FIG. 3 is a schematic perspective view of a magnetic core included in the reactor in FIG. 1.

FIG. 4 is a schematic elevation view of an intervening member included in the reactor in FIG. 1.

FIG. 5 is a view showing a state in which inner core portions and an outer core portion are combined with the intervening member in FIG. 4.

FIG. 6 is an explanatory view for explaining positions of a first groove portion and a second groove portion of the outer core portion included in the reactor in FIG. 1.

FIG. 7 is an explanatory view for explaining a manufacturing method of the reactor of the first embodiment.

DETAILED DESCRIPTION OF PREFERRED EMBODIMENTS

First, aspects of the present disclosure will be listed and described.

A reactor according to one aspect of the present disclosure includes a coil that has a first winding portion and a second winding portion; and a magnetic core that has inner core portions, which are respectively disposed inside of the first winding portion and the second winding portion, and outer core portions that form an annular magnetic path with the inner core portions.

The reactor includes an inner resin portion that covers at least a part of the inner core portion and an outer resin portion that covers at least a part of the outer core portion. The outer core portion includes a first groove portion and a second groove portion that are open to a coil facing surface opposite to the coil, when viewed from the axial direction of the first winding portion. An opening of the first groove portion is located between the outer circumferential contour of the first winding portion and the outer circumferential contour of the inner core portion that is disposed inside of the first winding portion, when viewed from the axial direction of the second winding portion. An opening of the second groove portion is located between the outer circumferential contour of the second winding portion and the outer circumferential contour of the inner core portion that is disposed inside of the second winding portion, and the inner resin portion and the outer resin portion are connected via the first groove portion and the second groove portion.

The reactor having the above configuration is manufactured by molding a resin from the outside of the outer core portion and guiding the resin to the inside of the winding portion via the first groove portion and the second groove portion that are formed in the outer core portion. Due to the presence of the first groove portion and the second groove portion, the resin can be easily guided to the inside of the winding portion, and voids or the like are less likely to be formed inside of the winding portion. This is because the end portions in the axial direction of the first groove portion and the second groove portion are open to the coil facing surface of the outer core portion. The resin that is molded in the outer core portion forms an outer resin portion by being cured (solidified), and the resin that is filled inside of the winding portion via the groove portions forms an inner resin portion by being cured. Because the inner resin portion having few voids is excellent in strength, the inner resin portion is less likely to be damaged by vibrations or the like during use of the reactor, and the operation of the reactor is stabilized.

Also, because the flow path of the resin formed in the outer core portion is not a through hole passing through the outer core portion but a groove portion formed on the outer circumference of the outer core portion, the decrease in strength of the outer core portion, which is caused by providing the flow path, can be suppressed. Accordingly, the outer core portion is less likely to be damaged even if the filling pressure of the resin is high. Also, the groove portion can be easily formed in the outer circumference of the outer core portion. In addition, the groove portion formed in the outer circumference of the outer core portion is less likely to deteriorate the magnetic characteristics of the outer core portion.

In one aspect of the reactor according to the embodiment, the first groove portion and the second groove portion may be formed at positions, which are flanked by the pair of inner core portions, on an upper surface of the outer core portion.

If a resin is molded from the outside of the outer core portion and the resin is guided to the gaps between the first winding portion (second winding portion) and the inner core portion, the portion of the gaps sandwiched by the pair of inner core portions (referred to as the core-to-core portion) is less likely to be filled with the resin compared to the other portions. On the other hand, when viewed from the axial direction of the winding portion, if the two groove portions are formed at the positions flanked by the pair of inner core portions on the upper surface of the outer core portion, the resin can be easily filled into the core-to-core portion.

In another aspect of the reactor according to the embodiment, the outer core portion may have an outer surface opposite to the coil facing surface; and the first groove portion and the second groove portion may have a uniform width and depth from the coil facing surface to the outer surface.

By providing the two groove portions to connect the coil facing surface and the outer surface of the outer core portion, when a resin is filled from the outside of the outer core portion, the flow of the resin from the outer core portion to the inner core portion can be smoothed. Also, by providing the two groove portions to connect the coil facing surface and the outer surface of the outer core portion and making the width and the depth of the groove portions uniform, the outer core portion can be easily manufactured. This is because, when manufacturing the outer core portion, the outer core portion can be easily removed from the mold.

In another aspect of the reactor according to the embodiment, the width of the opening of the first groove portion and the width of the opening of the second groove portion may be 1 mm or more and 4 mm or less.

By setting the width of the openings of the two groove portions to 1 mm or more, the resin can be easily filled from the outside of the outer core portion to the inner core portion. Also, by setting the width of the openings of the two groove portions to 4 mm or less, the decrease in magnetic characteristics of the outer core portion, which is caused by providing the two groove portions, can be suppressed.

In another aspect of the reactor, when viewed from the axial direction of the first winding portion, the entire opening of the first groove portion may overlap an end surface of the first winding portion, and when viewed from the axial direction of the second winding portion, the entire opening of the second groove portion may overlap an end surface of the second winding portion.

The fact that the entire opening of the first groove portion (the second groove portion) overlaps the end surface of the first winding portion (the second winding portion) means that the two groove portions are disposed at positions distant from the connection portion with the inner core portion in the outer core portion. With this configuration, the decrease in magnetic characteristics of the magnetic core, which is caused by providing the first groove portion and the second groove portion, can be suppressed, and the reactor can be a low-loss reactor.

In another aspect of the reactor, when viewed from the axial direction of the first winding portion, a part of the opening of the first groove portion may overlap an end surface of the first winding portion, and when viewed from the axial direction of the second winding portion, a part of the opening of the second groove portion may overlap an end surface of the second winding portion.

The fact that a part of the opening of the first groove portion (the second groove portion) overlaps the end surface of the first winding portion (the second winding portion) means that the remaining portion of the opening overlaps the gap between the first winding portion (the second winding portion) and the inner core portion that is disposed inside of the first winding portion (the second winding portion). That is, because the opening of the groove portion is close to the above gap to be filled with a resin, the resin can be easily filled inside of the winding portion.

In another aspect of the reactor according to the embodiment, the relative permeability of the inner core portion may be 5 or more and 50 or less, and the relative permeability of the outer core portion may be 50 or more and 500 or less, and may be higher than the relative permeability of the inner core portion.

By making the relative permeability of the outer core portion higher than the relative permeability of the inner core portion, the leakage magnetic flux between the two core portions can be reduced. In particular, by making the difference between the relative permeabilities of the two core portions large, the leakage magnetic flux between the two core portions can be reliably reduced. Depending on the difference, the leakage magnetic flux can be considerably reduced. Also, in the above embodiment, because the relative permeability of the inner core portion is low, it is possible to suppress the relative permeability of the entire magnetic core from becoming too high, and a magnetic core having a gapless structure can be obtained.

In another aspect of the reactor, the inner core portion may be formed of a molded product of a composite material containing soft magnetic powder and a resin.

The relative permeability of the molded product of the composite material can be easily lowered by adjusting the amount of the soft magnetic powder. Accordingly, if a molded product of a composite material is used, an inner core portion having a relative permeability that satisfies the range of 7 can be easily manufactured.

In another aspect of the reactor, the outer core portion may be formed of a powder compact of soft magnetic powder.

If a powder compact is used, the outer core portion that has the first groove portion and the second groove portion can be manufactured with high accuracy. In addition, if a powder compact that contains dense soft magnetic powder is used, an outer core portion having the relative permeability that satisfies the range of 7 can be easily manufactured.

The following describes embodiments of a reactor according to the present disclosure with reference to drawings. Elements having the same name are denoted by the same reference numerals throughout the drawings. Note, that the present disclosure is not limited to the configuration shown in the embodiments, and is specified by the scope of claims. All changes that come within the meaning and range of equivalency of the claims are intended to be embraced.

First Embodiment

In the first embodiment, the configuration of a reactor 1 will be described based on FIGS. 1 to 7. The reactor 1 shown in FIG. 1 is constituted by combining a coil 2, a magnetic core 3, and intervening members 4. The reactor 1 further includes inner resin portions 5 (see FIG. 2) that are disposed inside of the first winding portion 2A and the second winding portion 2B of the coil 2, and outer resin portions 6 that cover outer core portions 32 constituting a part of the magnetic core 3. As one characteristic of the reactor 1, first groove portions g1 and second groove portions g2 are formed in the outer core portions 32. The following describes the configuration of the reactor 1 in detail. The shape, positions, and functions of the above groove portions g1 and g2 will be described in detail in the following sections.

Coil

As shown in FIG. 1, the coil 2 of this embodiment includes a pair of first winding portion 2A and second winding portion 2B and a coupling portion 2R that couples the two winding portions 2A and 2B. The winding portions 2A and 2B each have a hollow tubular shape with the same number of turns wound in the same direction, and are arranged side by side such that their axial directions are parallel with each other. In this example, the coil 2 is formed by coupling the winding portions 2A and 2B, which have been manufactured using separate winding wires 2*w*. However, the coil 2 may also be manufactured using a single winding wire 2*w*.

The winding portions 2A and 2B according to this embodiment each have a rectangular tube shape. The winding portions 2A and 2B that have a rectangular tube shape are winding portions that have an end surface that has a rectangular shape (which may be a square shape) with rounded corners. As a matter of course, the winding portions 2A and 2B may also have a cylindrical shape. Winding portions that each have a cylindrical shape are winding portions that have an end surface that has a closed curved surface shape (such as an elliptical shape, a perfect circular shape, or a race track shape).

The coil 2 including the winding portions 2A and 2B may be made of a coated wire in which the outer circumferential surface of a conductor such as a flat wire or a round wire that is made of a conductive material such as copper, aluminum, magnesium, or an alloy thereof is coated with an insulative coating that is made of an insulative material. In this embodiment, the winding portions 2A and 2B are formed through edgewise-winding of a coated flat wire that includes a conductor that is made of a copper flat wire (a winding wire 2*w*) and an insulative coating that is made of enamel (typically polyamide imide).

Two end portions 2*a* and 2*b* of the coil 2 are drawn out of the winding portions 2A and 2B, and are connected to terminal members (not shown). The insulative coating, which is made of enamel or the like, has been peeled off from the end portions 2*a* and 2*b*. An external device such as a power supply for supplying power to the coil 2 is connected via the terminal members.

Magnetic Core

As shown in FIGS. 1 and 2, the magnetic core 3 includes inner core portions 31, which are respectively disposed inside of the first winding portion 2A and the second winding portion 2B, and outer core portions 32 that form a closed magnetic circuit with the inner core portions 31.

Inner Core Portions

The inner core portions 31 are portions along the axial direction of the winding portions 2A and 2B of the coil 2 in the magnetic core 3. In this example, as shown in FIG. 2, the two end portions of the magnetic core 3 in the axial direction of the winding portions 2A and 2B protrude from the end surfaces of the winding portions 2A and 2B (see the positions of end surfaces 31*e* of the inner core portion 31). These protruding portions are also part of the inner core portions 31.

The shape of the inner core portions 31 is not particularly limited as long as the shape is a shape that conforms to the inner shape of the inner winding portion 2A (2B). Each inner core portion 31 of this example has a substantially rectangular parallelepiped shape. The inner core portion 31 may have a structure in which multiple split cores and gap plates are connected, but if one member is used as in this example, it is easy to assemble the reactor 1, which is preferable.

Outer Core Portions

The outer core portions 32 of the magnetic core 3 are portions that are disposed outside of the winding portions 2A and 2B. The shape of the outer core portion 32 is not particularly limited as long as it is a shape connecting the end portions of the pair of inner core portions 31. Each outer core portion 32 of this example has a substantially rectangular parallelepiped shape. The outer core portion 32 has a coil facing surface 32*e* opposite to the end surfaces of the winding portions 2A and 2B of the coil 2, an outer surface 32*o* opposite to the coil facing surfaces 32*e*, and circumferential surfaces 32*s*. As shown in FIGS. 2 and 3, the coil facing surface 32*e* of the outer core portion 32 and the end surface 31*e* of the inner core portion are in contact with each other, or substantially in contact with each other via an adhesive. In this example, as shown in FIG. 3, a first groove portion g1 and a second groove portion g2 are formed in an upper surface 32*u*, which is a circumferential surface 32*s* of the outer core portion 32 that faces vertically upward. As described later, the two groove portions g1 and g2 are used for improving the resin filling property when the resin serving as an inner resin portion 5 is filled inside of the winding portions 2A and 2B.

Magnetic Characteristics, Materials, and so on

The relative permeability of the inner core portion 31 is preferably 5 or more and 50 or less, the relative permeability of the outer core portion 32 is preferably 50 or more and 500 or less and is preferably higher than the relative permeability of the inner core portion 31. The relative permeability of the inner core portion can be further set to 10 or more and 45 or less, 15 or more and 40 or less, or 20 or more and 35 or less. On the other hand, the relative permeability of the outer core portion 32 can be further set to 80 or more, 100 or more, 150 or more, or 180 or more. By making the relative permeability of the outer core portion 32 higher than the relative permeability of the inner core portion 31, the leakage magnetic flux between the two core portions 31 and 32 can be reduced. In particular, by making the difference between the relative permeabilities of the two core portions 31 and 32 large, for example, by making the relative permeability of the outer core portion 32 twice or more the relative permeability of the inner core portion 31, the leakage magnetic flux between the two core portions 31 and 32 can be further reduced. Also, in the above embodiment, because the relative permeability of the inner core portion 31 is lower than the relative permeability of the outer core portion 32, it is possible to suppress the relative permeability of the entire magnetic core 3 from becoming too high, and a magnetic core 3 of a gapless structure can be obtained.

The inner core portion 31 and the outer core portion 32 can be constituted by a powder compact that is obtained by molding raw material powder containing soft magnetic powder, or a molded product of a composite material of soft magnetic powder and a resin. The soft magnetic powder of the powder compact is an aggregate of soft magnetic particles composed of an iron group metal such as iron or an alloy thereof (e.g., Fe—Si alloy, Fe—Ni alloy), or the like. An insulative coating composed of phosphate or the like may be formed on the surface of the soft magnetic particles. The material powder may contain a lubricant and the like.

As soft magnetic powder of the composite material, the same soft magnet powder that is used for the powder compact can be used. On the other hand, examples of a resin contained in the composite material include a thermosetting resin, a thermoplastic resin, a normal temperature hardening resin, and a low temperature hardening resin. The thermosetting resin may be an unsaturated polyester resin, an epoxy resin, a urethane resin, or a silicone resin. The thermoplastic resin may be a polyphenylene sulfide (PPS) resin, a polytetrafluoroethylene (PTFE) resin, a liquid crystal polymer (LCP), a polyamide (PA) resin such as nylon 6 and nylon 66, a polybutylene terephthalate (PBT) resin, or an acrylonitrile-butadiene-styrene (ABS) resin. In addition, BMC (bulk molding compound) in which calcium carbonate or glass fiber is mixed with unsaturated polyester, millable silicone rubber, millable urethane rubber, or the like can be used. The above composite material can further enhance heat dissipation if it contains nonmagnetic and nonmetallic powder (filler) such as alumina and silica in addition to soft magnetic powder and a resin. The content of the nonmagnetic and nonmetallic powder may be 0.2 mass % or more and 20 mass % or less, further 0.3 mass % or more 15 mass % or less, or 0.5 mass % or more and 10 mass % or less.

The content of the soft magnetic powder in the composite material may be 30 volume % or more and 80 volume % or less. From the viewpoint of improving saturation magnetic flux density and heat dissipation, the content of the magnetic powder can be further set to 50 volume % or more, 60 volume % or more, or 70 volume % or more. From the viewpoint of improving the flowability in the manufacturing processes, it is preferable that the content of the magnetic powder is 75 volume % or less. If the filling rate of the soft magnetic powder is adjusted to be low, the relative permeability of the molded product of the composite material can be easily lowered. Accordingly, a molded product of a composite material is suitable for manufacturing the inner core portion 31 that satisfies the relative permeability of 5 or more and 50 or less. In this example, the inner core portion 31 is formed of a forming body of the composite material, and its relative permeability is set to 20.

The content of the soft magnetic powder in the powder compact can be more easily increased than that in the molded product of the composite material (e.g., more than 80 volume %, further 85 volume % or more), and a core piece having a higher saturation magnetic flux and relative permeability can be easily obtained. Accordingly, a powder compact is suitable for manufacturing the outer core portion 32 whose relative permeability is 50 or more and 500 or less. In this example, the outer core portion 32 is formed of a powder compact, and its relative permeability is set to 200.

Intervening Members

The reactor 1 shown in FIG. 1 further includes intervening members 4 that are interposed between the coil 2 and the magnetic core 3. Each intervening member 4 is typically made of an insulating material. The intervening member 4 serves as an insulating member between the coil 2 and the magnetic core 3, and a positioning member for the inner core portions 31 and the outer core portions 32 with respect to the winding portions 2A and 2B. The intervening member 4 of this example is a rectangular frame-shaped member, and also serves as a member for forming the flow path of a resin to be filled in the winding portions 2A and 2B.

The following describes one example of the intervening member 4 with reference to FIGS. 4 and 5. FIG. 4 is an elevation view of the intervening member 4 as viewed from the side on which the outer core portion 32 (FIG. 1) is disposed. The other side on which the winding portions 2A and 2B (FIG. 1) are disposed is behind the paper plane, and cannot be seen. FIG. 5 is a view showing a state in which the inner core portions 31 and one of the outer core portions 32 are assembled with the intervening member 4 in FIG. 4.

As shown in FIG. 4, the intervening member 4 includes a pair of through holes 41*h*, multiple support portions 41 that are provided in each through hole 41, a coil accommodation portion (not shown), and a core accommodation portion 42. Each through hole 41 passes through the intervening member 4 in the thickness direction, and, as shown in FIG. 5, the inner core portions 31 are inserted through the through holes 41*h*. The inner circumferential surfaces forming the through holes 41*h* substantially coincide with the inner circumferential surfaces of the winding portions 2A and 2B (FIG. 1). Each support portion 41 partially protrudes from the inner circumferential surface of the through hole 41*h* and supports the four corner portions of the inner core portion 31. The coil accommodation portion is provided on the other surface side of the intervening member 4, which is not shown on the drawing, and the end surfaces of the winding portions 2A and 2B (FIG. 1) and their vicinities are fitted to the coil accommodation portion. The core accommodation portion 42 is formed by partially recessing a part of one surface side of the intervening member 4 in the thickness direction, and the coil facing surface 32*e* of the outer core portion and its vicinity are fitted into the core accommodation portion 42. The end surface 31*e* (FIG. 5) of the inner core portion 31 that is fitted into the through hole 41*h* of the intervening member 4 protrudes from the bottom surface of the core accommodation portion 42 (see FIG. 7, which is described later). Accordingly, the outer core portion 32 that is fitted into the core accommodation portion 42 is separated from the bottom portion of the core accommodation portion 42. The gap formed by the outer core portion 32 separating from the bottom portion of the core accommodation portion 42 is the flow path of a resin, which will be described later.

In the intervening member 4 of this example, as shown in FIG. 5, the winding portions 2A and 2B are fitted into the coil accommodation portion, and four resin filling holes h1, h2, h3, and h4 communicating with the gap between the winding portions 2A and 2B and the inner core portion 31 are formed in a state where the inner core portions 31 are respectively inserted through the through holes 41*h*. More specifically, the resin filling hole h1 is formed between the upper end edge of the end surface 31*e* of the inner core portion 31 and the inner circumferential surface of the through hole 41*h* (FIG. 4), and the resin filling hole h2 is formed between the outer side edge of the end surface 31*e* and the inner circumferential surface of the through hole 41. Also, the resin filling hole h3 is formed between the inner side edge of the end surface 31*e* and the inner circumferential surface of the through hole 41*h*, and the resin filling hole h4 is formed between the lower side edge of the end surface 31*e* and the inner circumferential surface of the through hole 41*h*. The resin filling holes h1 and h2 are not covered with the outer core portion 32, but the resin filling holes h3 and h4 are covered with the outer core portion 32. For improving the resin filling property from the resin filling holes h3 and h4 that are covered with the outer core portion 32, in the reactor 1 of this example, the first groove portion g1 and the second groove portion g2 are provided on the upper surface 32*u* of the outer core portion 32.

The intervening member 4 can be formed of, for example, a thermoplastic resin such as a polyphenylene sulfide (PPS) resin, a polytetrafluoroethylene (PTFE) resin, a liquid crystal polymer (LCP), a polyamide (PA) resin such as nylon 6 and nylon 66, a polybutylene terephthalate (PBT) resin, or an acrylonitrile-butadiene-styrene (ABS) resin. In addition, the intervening member 4 can be formed of, for example, a thermosetting resin such as an unsaturated polyester resin, an epoxy resin, a urethane resin, or a silicone resin. For improving the heat dissipation of the intervening member 4, a ceramic filler may be contained in these resins. As a ceramic filler, for example, nonmagnetic powder such as alumina or silica can be used.

Inner Resin Portions

As shown in FIG. 2, the inner resin portion 5 is disposed inside of the first winding portion 2A (the same also applies to the second winding portion 2B (not shown)), and joins the inner circumferential surface of the first winding portion 2A and the outer circumferential surface of the inner core portion 31. The inner resin portion 5 is retained inside of the first winding portion 2A without spanning between the inner circumferential surface and the outer circumferential surface of the first winding portion 2A. That is, as shown in FIG. 1, the outer circumferential surfaces of the winding portions 2A and 2B are exposed to the outside without being covered with the resin.

For the inner resin portion 5, for example, a thermosetting resin such as an epoxy resin, a phenol resin, a silicone resin, and a urethane resin, a thermoplastic resin such as a PPS resin, a PA resin, a polyamide resin, and a fluororesin, a normal temperature hardening resin, or a low temperature hardening resin can be used. For improving the heat dissipation of the inner resin portion 5, a ceramic filler such as alumina and silica may be contained in these resins.

Substantially no large void is formed inside of the inner resin portion 5, and furthermore, substantially no small void is formed inside of the inner resin portion 5. The reason for this will be described in detail below, in the description of "Manufacturing Method of Reactor".

Outer Resin Portions

As shown in FIGS. 1 and 2, the outer resin portions 6 are disposed to cover the entire outer circumferential surfaces exposed from the intervening members 4 in the outer core portions 32. The outer resin portions 6 fix the outer core portions 32 to the intervening members 4 and protect the outer core portions 32 from the external environment. The outer resin portions 6 of this example are connected to the inner resin portions 5. That is, the outer resin portion 6 and the inner resin portion 5 are formed of the same resin at one time. Here, unlike in this example, the lower surface of the outer core portion 32 may also be exposed from the outer resin portion 6. In this case, it is preferable that the portion of the lower portion of the outer core portion 32 (the portion on the outer surface 32 side), which is not fitted into the intervening member 4, is flush with the lower surface of the intervening member 4. By directly bringing the lower surface of the outer core portion 32 into contact with the surface on which the reactor 1 is to be installed, or by interposing an adhesive or an insulating sheet between the surface on which the reactor 1 is to be installed and the lower surface of the outer core portion 32, the heat dissipation of the magnetic core 3 including the outer core portions 32 can be enhanced.

The outer resin portion 6 of this example is provided on the side of the intervening member 4 where the outer core portion 32 is disposed, and not provided on the outer circumferential surfaces of the winding portions 2A and 2B. In view of the function of the outer resin portions 6 for fixing and protecting the outer core portions 32, the extent of forming the outer resin portions 6 is sufficient as shown in the drawing, which is preferable in that the amount of resin to be used can be reduced. As a matter of course, unlike in the illustrated example, the outer resin portions 6 may also extend to the winding portions 2A and 2B.

First Groove Portions and Second Groove Portions

The first groove portions g1 and the second groove portions g2 that are provided in the outer core portions 32 will be described with reference to FIGS. 1, 3, 4, and 6. Here, FIG. 6 is a view showing a state in which the intervening member 4 is removed from the state shown in FIG. 5.

The first groove portions g1 and the second groove portions g2 are formed so that, when a resin is molded from the outside of the outer core portion 32, the resin easily flows into the resin filling holes h3 and h4 (FIG. 5) that are covered with the outer core portion 32. In view of this, as shown in FIG. 3, the groove portions g1 and g2 need to be open to the coil facing surface 32*e*. The two groove portions g1 and g2 may be provided at any position on the circumferential surface 32*s* of the outer core portion 32. In this example, the groove portions g1 and g2 are provided on the upper surface 32*u* of the outer core portion 32, and, as shown in FIG. 6, are provided at a position flanked by the pair of inner core portions 31 when viewed from the axial direction of the winding portions 2A and 2B.

As shown in FIG. 6, when viewed from the axial direction of the first winding portion 2A, the opening of the first groove portion g1 is positioned at a first region R1 between the outer circumferential contour of the first winding portion 2A and the outer circumferential contour of the inner core portion 31 that is disposed inside of the first winding portion 2A. Also, when viewed from the axial direction of the second winding portion 2B, the opening of the second groove portion g2 is positioned at a second region R2 between the outer circumferential contour of the second winding portion 2B and the outer circumferential contour of the inner core portion 31 that is disposed inside of the second winding portion 2B. The resin that flows into the gap between the outer core portion 32 and the intervening member 4 shown in FIG. 5 from the openings of the groove portions g1 and g2 flows into the inside of the winding portions 2A and 2B (see FIG. 6) from the resin filling holes h3 and the resin filling holes h4. Here, if the first groove portion g1 and the second groove portion g2 are connected as one large groove portion, the resin is less likely to flow into the gap between the intervening member 4 and the outer core portion 32, and the magnetic characteristics of the outer core portion 32 are likely to be deteriorated because the outer core portion 32 is largely cut out.

As shown in FIG. 3, it is preferable that the groove portions g1 and g2 have a uniform width and depth from the coil facing surface 32*e* to the outer surface 32*o*. The groove portions g1 and g2 may have a length that does not reach the outer surface 32*o*. However, if the groove portions g1 and g2 have a length that reaches the outer surface 32*o*, when a resin is molded from the outside of the outer core portion 32, the flow of the resin from the outer core portion 32 to the inner core portion 31 can be smoothed. In addition, by providing the two groove portions g1 and g2 to connect the coil facing surface 32*e* and the outer surface 32*o* of the outer core portion 32 and making the width and the depth of the groove portions uniform, the outer core portion 32 can be easily manufactured. This is because, when manufacturing the outer core portion 32, the outer core portion 32 can be easily removed from the mold.

It is preferable that the width of the openings of the groove portions g1 and g2 shown in FIG. 6 is 1 mm or more and 4 mm or less. The width of the opening is the maximum distance between the inner walls of the distances between the opposing inner walls of the groove portions g1 and g2. In this example, the separation distance of the upper end of one of the inner walls of the groove portions g1 and g2 and the upper end of the other inner wall is the width of the groove portions g1 and g2. By setting the width of the openings of the groove portions g1 and g2 to 1 mm or more, a resin can be easily filled from the outside of the outer core portion 32 to the inner core portion 31. Also, by setting the width of the openings of the groove portions g1 and g2 to 4 mm or less, the decrease of the magnetic characteristics of the outer core portion 32, which is caused by providing the groove portions g1 and g2, can be suppressed. More preferably, the width of the groove portions g1 and g2 is 1 mm or more and 2 mm or less.

It is preferable that the depth of the groove portions g1 and g2 is 1 mm or more and 4 mm or less. The depth of the groove portions g1 and g2 is the distance from the upper opening portion of the groove portion g1 and g2 to the deepest portion. By setting the depth of the groove portions g1 and g2 to 1 mm or more, the resin can be easily filled from the outside of the outer core portion 32 to the inner core portion 31. Also, by setting the depth of the groove portions g1 and g2 to 4 mm or less, the decrease of the magnetic characteristics of the outer core portion 32, which is caused by providing the groove portions g1 and g2, can be suppressed. More preferably, the depth of the groove portions g1 and g2 is 1 mm or more and 2 mm or less.

The shape of the inner circumferential surface of the groove portions g1 and g2 orthogonal to the extending direction of the groove portions g1 and g2 is not particularly limited. The shape of the inner circumferential surface of the groove portions g1 and g2 may be, for example, an arc shape as in this example, or may be a V shape.

In addition, the position of the first groove portion g1 (the second groove portion g2) in the first region R1 (the second region R2) will be described. First, as shown in FIG. 6, in one aspect of the present disclosure, when viewed from the axial direction of the first winding portion 2A (the second winding portion 2B), the entire opening of the first groove portion g1 (the second groove portion g2) overlaps the end surface of the first winding portion 2A (the second winding portion 2B). In this configuration, as shown in FIG. 3, the two groove portions g1 and g2 are disposed at positions distant from the connection portion with the inner core portion 31 in the outer core portion 32. In this case, the decrease of the magnetic characteristics of the magnetic core 3 caused by providing the groove portions g1 and g2 can be suppressed, and the low-loss reactor 1 can be obtained (FIG. 1).

Unlike the configuration shown in FIG. 6, in another aspect of the present disclosure, when viewed from the axial direction of the first winding portion 2A (the second winding portion 2B), a part of the opening of the first groove portion g1 (the second groove portion g2) overlaps the end surface of the first winding portion 2A (the second winding portion 2B). The fact that a part of the opening of the first groove portion g1 (the second groove portion g2) overlaps the end surface of the first winding portion 2A (the second winding portion 2B) means that the remaining portion of the opening overlaps the gap between the first winding portion 2A (the second winding portion 2B) and the inner core portion 31 that is disposed inside of the first winding portion 2A (the second winding portion 2B). That is, because the openings of the groove portions g1 and g2 are close to the gap to be filled with a resin, the resin can be easily filled inside of the winding portions 2A and 2B.

Usage

The reactor 1 of this example can be used for a constructional element of a power conversion device such as a bi-directional DC-DC converter that is installed in electrically-driven vehicles such as hybrid vehicles, electric vehicles, or fuel-cell vehicles. The reactor 1 of this example can be used in a state immersed in a liquid refrigerant. The liquid refrigerant is not particularly limited. If the reactor 1 is used in hybrid vehicles, ATF (Automatic Transmission Fluid) or the like can be used as the liquid refrigerant. In addition, fluorine-based inert fluid such as Fluorinert (registered trademark), a chlorofluorocarbon-based refrigerant such as HCFC-123 and HFC-134a, an alcoholic-based refrigerant such as methanol and alcohols, and a ketone-based refrigerant such as acetone can be used as the liquid refrigerant. The winding portions 2A and 2B of the reactor 1 of this example are exposed to the outside. Accordingly, if the reactor 1 is cooled using a coolant such as a liquid refrigerant or the like, because the winding portions 2A and 2B can be brought into direct contact with the coolant, the reactor 1 of this example is excellent in heat dissipation.

Effects

In the reactor 1 of this example, substantially no large void is formed in the inner resin portions 5 that are filled inside of the winding portions 2A and 2B. Because the inner resin portion 5 having no large void and few small voids is excellent in strength, the inner resin portion 5 is less likely to be damaged by vibrations or the like during use of the reactor 1, and the operation of the reactor 1 is stabilized. The reason why voids are less likely to be formed in the inner resin portion 5 will be described in detail in "Manufacturing Method of Reactor", which will be described later.

In addition, in the reactor 1 of this example, because the outer circumferences of the winding portions 2A and 2B of the coil 2 are not molded by a resin and are directly exposed to the external environment, the reactor 1 of this example is excellent in heat dissipation. If the reactor 1 is immersed in a liquid refrigerant, the heat dissipation of the reactor 1 can be further improved.

Manufacturing Method of Reactor

Next, one example of a reactor manufacturing method for manufacturing the reactor 1 according to the first embodiment will be described. A manufacturing method of a reactor generally includes the following processes.

Coil manufacturing process

Assembling process

Filling process

Curing process

Coil Manufacturing Process

In this process, a winding wire 2*w* is prepared, and a coil 2 is manufactured by winding a part of the winding wire 2*w*. For winding the winding wire 2*w*, a known winding machine can be used. The coil 2 may be subjected to a heat treatment after a heat fusible resin layer is formed on the surface of the winding wire 2*w* and the winding portions 2A and 2B are formed by winding the winding wire 2*w*. In this case, the respective turns of the winding portions 2A and 2B can be integrated, and the filling process to be described later can be easily performed.

Assembling Process

In this process, the coil 2, the magnetic core 3, and the intervening members 4 are assembled. The inner core portions 31 are respectively disposed inside of the winding portions 2A and 2B, for example, and a first assembly is manufactured in which the pair of intervening members 4 are brought into contact with end surfaces on one end side and the other end side in the axial direction of the winding portions 2A and 2B, respectively. Then, a second assembly is manufactured by sandwiching the first assembly with the pair of outer core portions 32. The end surface 31*e* of the inner core portion 31 and the coil facing surface 32*e* of the outer core portion 32 can be joined using an adhesive or the like.

Here, as shown in FIG. 5, when the second assembly is viewed from the outside of the outer core portion 32, the resin filling holes h1 and h2 for filling a resin inside of the winding portions 2A and 2B are formed in the side edges and the upper edges of the outer core portion 32. Also, although being covered with the outer core portion 32, the resin filling holes h3 and h4 are formed in the inner edges and lower edges of the inner core portion 31.

Filling Process

In the filling process, a resin is filled inside of the winding portions 2A and 2B of the second assembly. In this example, as shown in FIG. 7, the second assembly is placed in a mold 7, and injection molding is performed for injecting a resin into the mold 7. The pressure of the injection molding is, for example, 10 ton/cm$^2$ or more.

The resin is injected from two resin injection holes 70 of the mold 7. The resin injection holes 70 are provided at the positions corresponding to the outer surfaces 32*o* of the outer core portions 32. The resin is injected from the outer side (the outer surface 32*o* side) of the outer core portion 32. The resin that is filled into the mold 7 covers the outer circumferences of the outer core portions 32, goes around the outer circumferential surfaces of the outer core portions 32, and flows into the winding portions 2A and 2B via the resin filling holes h1 and h2 shown in FIG. 5. Also, the resin covering the outer core portions 32 flows into the gap between the coil facing surfaces 32*e* of the outer core portions 32 and the bottom portions of the core accommodation portions 42 of the intervening members 4 via the groove portions g1 and g2, and then flows into the winding portions 2A and 2B from the gap via the resin filling holes h3 and h4 shown in FIG. 5.

By increasing the pressure through injection molding, the resin filled into the winding portions 2A and 2B sufficiently spreads into the narrow gaps between the winding portions 2A and 2B and the inner core portions 31. Because the groove portions g1 and g2 that are formed in the outer circumferences of the outer core portions 32 hardly reduce the strength of the outer core portions 32, the outer core portions 32 are not damaged even if the pressure of the injection molding is increased.

Curing Process

In the curing process, the resin is cured through a heat treatment or the like. The cured resin inside of the winding portions 2A and 2B becomes, as shown in FIG. 2, the inner resin portions 5, and the cured resin covering the outer core portions 32 becomes the outer resin portions 6.

Effects

With the reactor manufacturing method described above, the reactor 1 shown in FIG. 1 can be manufactured. In the reactor 1, a resin is sufficiently filled inside of the winding portions 2A and 2B, especially, by the resin that flows into the winding portions 2A and 2B via the groove portions g1 and g2, and thus large voids are less likely to be formed in the inner resin portions 5 that are formed inside of the winding portions 2A and 2B.

Also, with the reactor manufacturing method of this example, because the inner resin portions 5 and the outer resin portions 6 are integrally formed, only one filling process and one curing process are needed. Accordingly, the reactor 1 can be manufactured with high productivity.

Second Embodiment

The reactor 1 of the first embodiment may be accommodated in a case, and buried in the case with a potting resin. The second assembly that is manufactured in the assembling process according to the manufacturing method of the reactor of the first embodiment is accommodated in the case, for example, and the potting resin is filled into the case. In this case, the potting case covering the outer circumferences of the outer core portions 32 is the outer resin portions 6. Also, the potting resin flowing into the winding portions 2A and 2B via the groove portions g1 and g2 of the outer core portions 32 is the inner resin portions 5.

What is claimed is:

1. A reactor comprising:

a coil that has a first winding portion and a second winding portion;

a magnetic core that has inner core portions, which are respectively disposed inside of the first winding portion and the second winding portion, and outer core portions that form an annular magnetic path with the inner core portions; an inner resin portion that covers at least a part of the inner core portion; and an outer resin portion that covers at least a part of the outer core portion, wherein, the outer core portion includes a first groove portion and a second groove portion that are open to a coil facing surface opposite to the coil, when viewed from the axial direction of the first winding portion, an opening of the first groove portion is located between the outer circumferential contour of the first winding portion and the outer circumferential contour of the inner core portion that is disposed inside of the first winding portion, when viewed from the axial direction of the second winding portion, an opening of the second groove portion is located between the outer circumferential contour of the second winding portion and the outer circumferential contour of the inner core portion that is disposed inside of the second winding portion, and the inner resin portion and the outer resin portion are connected via the first groove portion and the second groove portion.

2. The reactor according to claim 1, wherein the first groove portion and the second groove portion are formed at positions, which are flanked by the pair of inner core portions, on an upper surface of the outer core portion.

3. The reactor according to claim 1, wherein the outer core portion has an outer surface opposite to the coil facing surface; and the first groove portion and the second groove portion have a uniform width and depth from the coil facing surface to the outer surface.

4. The reactor according to claim 1, wherein the width of the opening of the first groove portion and the width of the opening of the second groove portion are 1 mm or more and 4 mm or less.

5. The reactor according to claim 1, wherein when viewed from the axial direction of the first winding portion, the entire opening of the first groove portion overlaps an end surface of the first winding portion, and when viewed from the axial direction of the second winding portion, the entire opening of the second groove portion overlaps an end surface of the second winding portion.

6. The reactor according to claim 1, wherein when viewed from the axial direction of the first winding portion, a part of the opening of the first groove portion overlaps an end surface of the first winding portion, and when viewed from the axial direction of the second winding portion, a part of the opening of the second groove portion overlaps an end surface of the second winding portion.

7. The reactor according to claim 1, wherein the relative permeability of the inner core portion is 5 or more and 50 or less, and the relative permeability of the outer core portion is 50 or more and 500 or less, and is higher than the relative permeability of the inner core portion.

8. The reactor according to claim 7, wherein the inner core portion is formed of a molded product of a composite material containing soft magnetic powder and a resin.

9. The reactor according to claim 7, wherein the outer core portion is formed of a powder compact of soft magnetic powder.

* * * * *